US008016536B2

(12) United States Patent
Gerber et al.

(10) Patent No.: US 8,016,536 B2
(45) Date of Patent: Sep. 13, 2011

(54) PIPE-HANDLING APPARATUS AND METHODS

(75) Inventors: Andrew Gerber, Calgary (CA); Douglas A. Hunter, Calgary (CA)

(73) Assignee: Canrig Drilling Technology Ltd., Houston, TX (US)

( * ) Notice: Subject to any disclaimer, the term of this patent is extended or adjusted under 35 U.S.C. 154(b) by 146 days.

(21) Appl. No.: 12/098,151

(22) Filed: Apr. 4, 2008

(65) Prior Publication Data

US 2009/0252576 A1 Oct. 8, 2009

(51) Int. Cl.
*E21B 19/00* (2006.01)
*E21B 19/15* (2006.01)

(52) U.S. Cl. ..... 414/22.61; 414/22.58; 414/728

(58) Field of Classification Search ..... 408/70; 414/22.51–22.58, 22.61–22.62, 22.68, 22.71, 414/477, 546, 745.4–746.8, 491, 498, 534, 414/742–743; 175/52, 85; 298/22 J, 22 P, 298/22 R; 89/1.802, 1.803, 1.804, 1.815
See application file for complete search history.

(56) References Cited

U.S. PATENT DOCUMENTS

| | | | | | |
|---|---|---|---|---|---|
| 982,977 | A | * | 1/1911 | Morgan | 414/391 |
| 1,440,155 | A | * | 12/1922 | Junkin | 298/22 R |
| 1,536,960 | A | * | 5/1925 | Martin | 298/22 D |
| 1,940,043 | A | * | 12/1933 | Bordeaux | 60/462 |
| 2,615,544 | A | | 10/1952 | Rynders | |
| 2,643,006 | A | * | 6/1953 | King | 414/22.52 |
| 2,880,881 | A | | 4/1959 | Robishaw | |
| 3,159,286 | A | | 12/1964 | Freeman, Sr. | |
| 3,169,645 | A | | 2/1965 | Freeman, Sr. | |
| 3,217,900 | A | * | 11/1965 | Kupetzky et al. | 414/742 |
| 3,307,719 | A | | 3/1967 | Martin, Jr. | |
| 3,494,483 | A | | 2/1970 | Smart | |
| 3,651,959 | A | | 3/1972 | Castela et al. | |
| 3,706,347 | A | | 12/1972 | Brown | |
| 3,780,883 | A | | 12/1973 | Brown | |
| 3,785,506 | A | | 1/1974 | Crocker et al. | |
| 3,810,553 | A | | 5/1974 | Crocker et al. | |

(Continued)

FOREIGN PATENT DOCUMENTS

CA 1139299 1/1983

(Continued)

OTHER PUBLICATIONS

International Search Report WO06/128300 (PCT/CA06/000904).

(Continued)

*Primary Examiner* — Gregory W Adams
(74) *Attorney, Agent, or Firm* — Haynes and Boone, LLP

(57) ABSTRACT

Apparatus and methods for moving a tubular member to and from an elevated drilling rig floor. In one embodiment, the apparatus comprises a support structure configured to be positioned adjacent a pipe rack. A carrier is moveably coupled to the support structure, and a carriage is moveably coupled to the carrier. A trough extends longitudinally over the support structure and is moveably coupled to the carriage, the trough being configured to receive a tubular member. The trough is operable to tilt relative to the support structure. A lift arm is operable to move the carriage relative to the support structure thereby also moving the tubular member received in the trough. Indexers may urge the tubular member toward or away from the trough. Pick up arms are operable to retrieve a tubular member from an adjacent pipe rack, or to place the tubular there for storage.

21 Claims, 11 Drawing Sheets

U.S. PATENT DOCUMENTS

| | | | | |
|---|---|---|---|---|
| 3,883,009 | A | 5/1975 | Swoboda, Jr. et al. | |
| 3,883,820 | A | 5/1975 | Burns et al. | |
| 3,894,515 | A | 7/1975 | Plyler | |
| 4,051,775 | A | 10/1977 | Watson | |
| 4,051,956 | A * | 10/1977 | Teague | 414/746.4 |
| 4,067,453 | A | 1/1978 | Moller | |
| 4,129,221 | A | 12/1978 | Moller | |
| 4,143,534 | A | 3/1979 | Hartkopf et al. | |
| 4,147,266 | A * | 4/1979 | Corompt | 414/480 |
| 4,235,566 | A | 11/1980 | Beeman et al. | |
| 4,347,028 | A | 8/1982 | Dugan | |
| 4,361,223 | A | 11/1982 | Johnson | |
| 4,379,676 | A | 4/1983 | Frias | |
| 4,380,297 | A | 4/1983 | Frias | |
| 4,382,738 | A | 5/1983 | Frias | |
| 4,386,883 | A | 6/1983 | Hogan et al. | |
| 4,403,898 | A | 9/1983 | Thompson | |
| 4,426,182 | A | 1/1984 | Frias et al. | |
| 4,470,740 | A | 9/1984 | Frias | |
| 4,474,520 | A | 10/1984 | Buckner et al. | |
| 4,494,899 | A | 1/1985 | Hoang et al. | |
| 4,533,055 | A * | 8/1985 | Haney | 211/70.4 |
| 4,696,207 | A | 9/1987 | Boyadjieff | |
| 4,709,766 | A | 12/1987 | Boyadjieff | |
| 4,765,401 | A | 8/1988 | Boyadjieff | |
| 4,960,356 | A | 10/1990 | Wrenn | |
| 5,077,852 | A | 1/1992 | Karlsson | |
| 5,137,114 | A | 8/1992 | Yde et al. | |
| 5,542,810 | A | 8/1996 | Florus | |
| 6,079,925 | A | 6/2000 | Morgan et al. | |
| 6,533,519 | B1 | 3/2003 | Tolmon et al. | |
| 7,163,367 | B2 | 1/2007 | Handley | |
| 7,300,239 | B2 * | 11/2007 | Benedikt | 414/546 |
| 7,469,749 | B2 | 12/2008 | Folk | |
| 7,473,065 | B2 | 1/2009 | Wells | |
| 2003/0155154 | A1 | 8/2003 | Oser | |
| 2004/0136813 | A1 | 7/2004 | Pietras | |
| 2004/0197166 | A1 | 10/2004 | Tolman et al. | |
| 2004/0208730 | A1 | 10/2004 | Morelli et al. | |
| 2005/0079044 | A1 | 4/2005 | Handley | |
| 2006/0045655 | A1 | 3/2006 | Wells | |
| 2006/0104746 | A1 * | 5/2006 | Thompson | 414/22.54 |
| 2006/0124356 | A1 | 6/2006 | Gust et al. | |
| 2006/0285941 | A1 | 12/2006 | Fikowski et al. | |
| 2007/0114113 | A1 | 5/2007 | Muse et al. | |
| 2007/0177967 | A1 | 8/2007 | Lesko | |
| 2007/0193749 | A1 | 8/2007 | Folk | |
| 2007/0221385 | A1 | 9/2007 | Braun et al. | |
| 2007/0286708 | A1 | 12/2007 | Smith et al. | |
| 2009/0196711 | A1 | 8/2009 | Gerber et al. | |

FOREIGN PATENT DOCUMENTS

| | | |
|---|---|---|
| CA | 1161427 | 1/1984 |
| CA | 1185228 | 4/1985 |
| CA | 1195241 | 10/1985 |
| CA | 1254194 | 5/1989 |
| CA | 2224638 | 12/1997 |
| CA | 2115810 | 10/1998 |
| CA | 2496440 | 11/2003 |
| CA | 2508998 | 12/2006 |
| CA | 2551884 | 1/2007 |
| EP | 1888872 | 2/2008 |
| UA | 97126104 | 8/1999 |
| UA | 2005 08442 | 1/2006 |
| WO | WO2006/128300 A1 | 12/2006 |

OTHER PUBLICATIONS

PCT Written Opinion of the International Searching Authority WO06/128300 (PCT/CA06/000904).

PCT International Preliminary Report on Patentability WO06/128300 (PCT/CA06/000904).

Operating Manual for the Pipe Handler—machine set-up, 41 pages.

http://www.columbiacorp.com/#/products/pipe-handlers/4-arm-pipe-handler/, Web site Screen Shot, 1 page.

http://www.columbiacorp.com/#/our-company/video-gallery/, Web site Screen Shot, 1 page.

* cited by examiner

PIPE-HANDLING APPARATUS AND METHODS

CROSS-REFERENCE TO RELATED APPLICATIONS

This application is related to U.S. application Ser. No. 10/908,951, entitled "PIPE-HANDLING APPARATUS," filed Jun. 1, 2005, the disclosure of which is hereby incorporated herein by reference.

This application is also related to U.S. application Ser. No. 12/023,730, entitled "PIPE-HANDLING APPARATUS AND METHODS," filed Jan. 31, 2008, the disclosure of which is hereby incorporated herein by reference.

BACKGROUND

During borehole-forming and completion operations, it is necessary to make up and/or break down long strings of tubular goods such as drill pipe and casing. The string of pipe may be thousands of feet long, and it is therefore necessary to transport pipe joints (approximately 28 to 32 feet in length) from a pipe rack located away from the rig up to the rig floor. When being tripped out of the hole, the string of pipe is broken down into separate joints and returned to the pipe rack.

The handling of oil well pipe is one of the most dangerous jobs on a drilling rig. Some of the pipe joints weigh thousands of pounds, and it is difficult to move the pipe from a horizontal position below and away from the rig into a vertical position overlying hole center in the rig.

BRIEF DESCRIPTION OF THE DRAWINGS

The present disclosure is best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION

Figure 1:
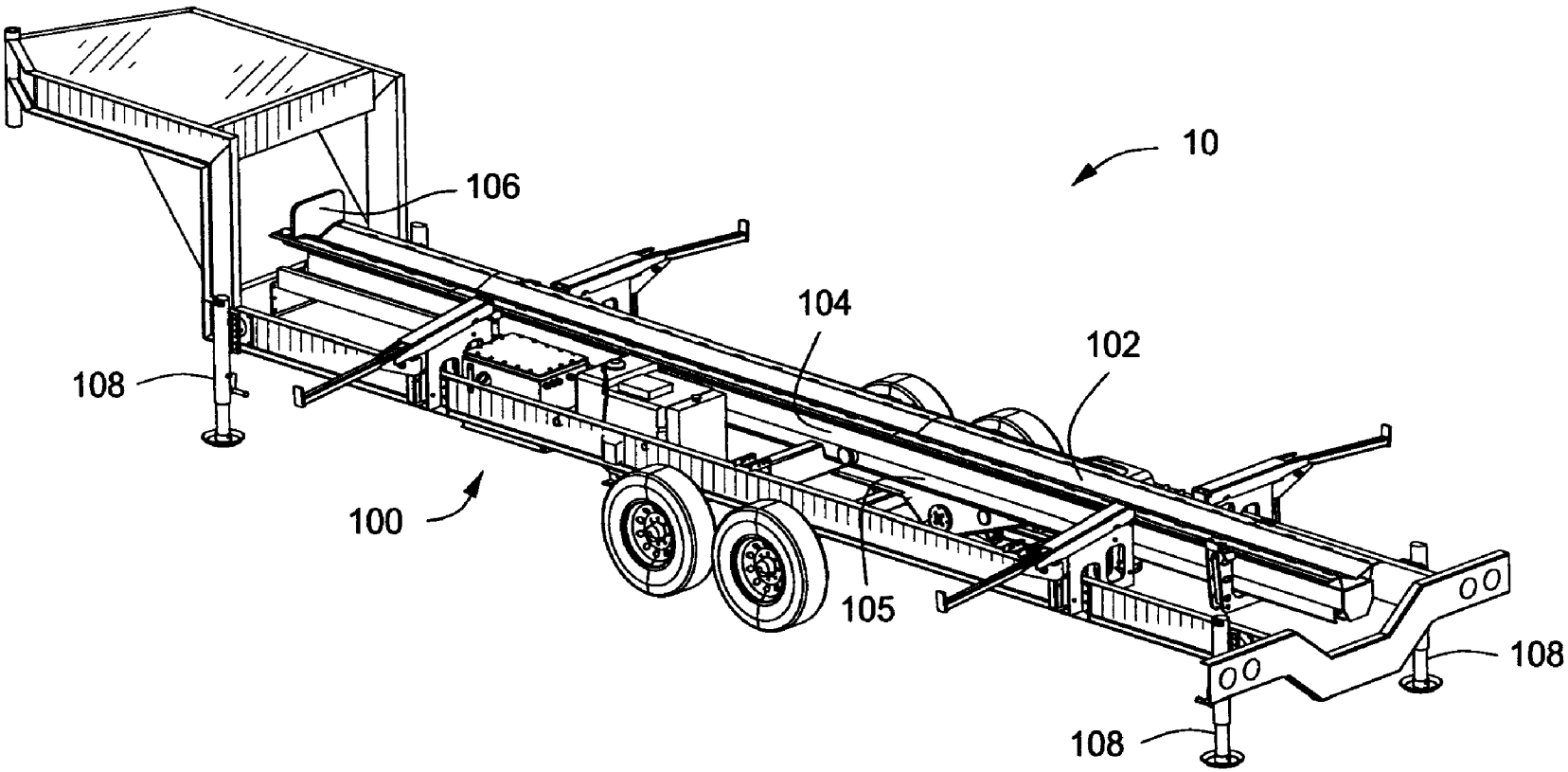
FIG. 1 is a perspective view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a perspective view of an apparatus 10 according to one or more aspects of the present disclosure. The apparatus 10 comprises a support structure 100. In an exemplary embodiment, the support structure 100 may comprise a goose-neck trailer that is configured to be easily transported to and from a worksite. The support structure 100 further comprises an elongate trough 102 that extends longitudinally along the length of the support structure 100. The trough 102 is upwardly opening and configured to accommodate a tubular member therein. In an exemplary embodiment, the elongate trough 102 is moveably coupled to a carriage 104, and the carriage 104 is moveably coupled to a carrier 105. The combination carriage 104 and carrier 105 is configured to support the elongate trough 102 during operation and transport. The elongate trough 102 may comprise a pipe stop member 106 configured to prevent a tubular member seated in the elongate trough 102 from sliding axially backwards during operation.

In an exemplary embodiment, the support structure 100 may additionally comprise a plurality of leveling legs 108 independently operable to adjust the height and angle of the support structure 100 relative to the underlying terrain. The leveling legs 108 may also function to align the support structure 100 with an adjacent pipe storage rack (see FIG. 8). In an exemplary embodiment, the leveling legs 108 may comprise at least four hydraulically-operable linear actuators, pneumatic actuators, and/or geared electric motor actuators. In another embodiment, the leveling legs 108 may comprise manual cranks configured to allow a user to manually raise, lower, and tilt the entire apparatus 10 relative to the underlying terrain.

Figure 2:
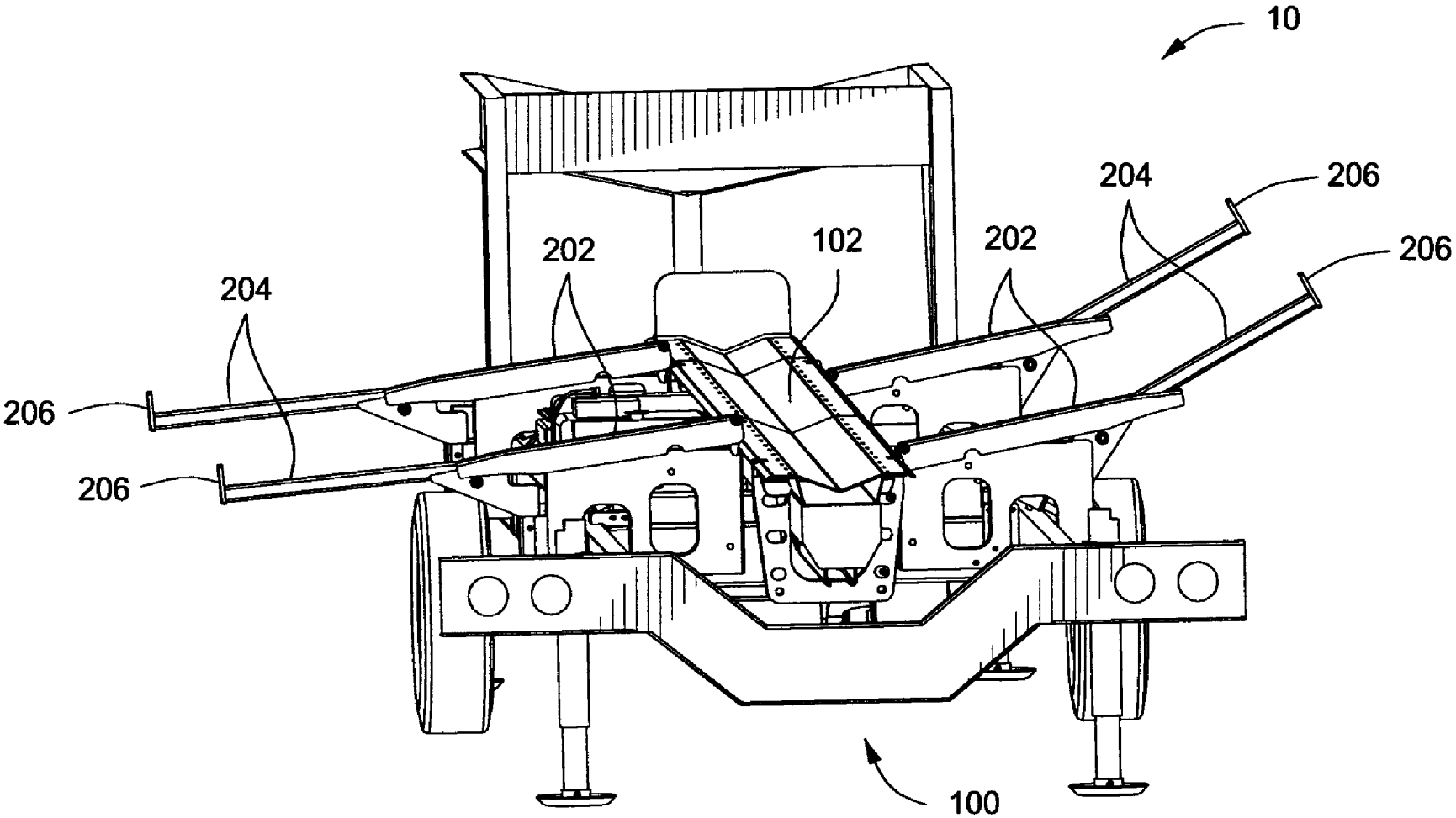
FIG. 2 is a rear perspective view of the apparatus shown in FIG. 1.

Referring to FIG. 2, the apparatus 10 may also comprise a plurality of indexers 202 and pick up arms 204 that are configured to operate in unison to urge tubular members towards and away from the elongate trough 102. The pick up arms 204 may comprise pipe stop ends 206 operable to prevent a tubular member from rolling off of the pick up arm 204 when positioned in a downward direction. In an exemplary embodiment, the pick up arms 204 may be configured to lift tubular members off of an adjacent pipe rack of varying heights.

Figure 3:
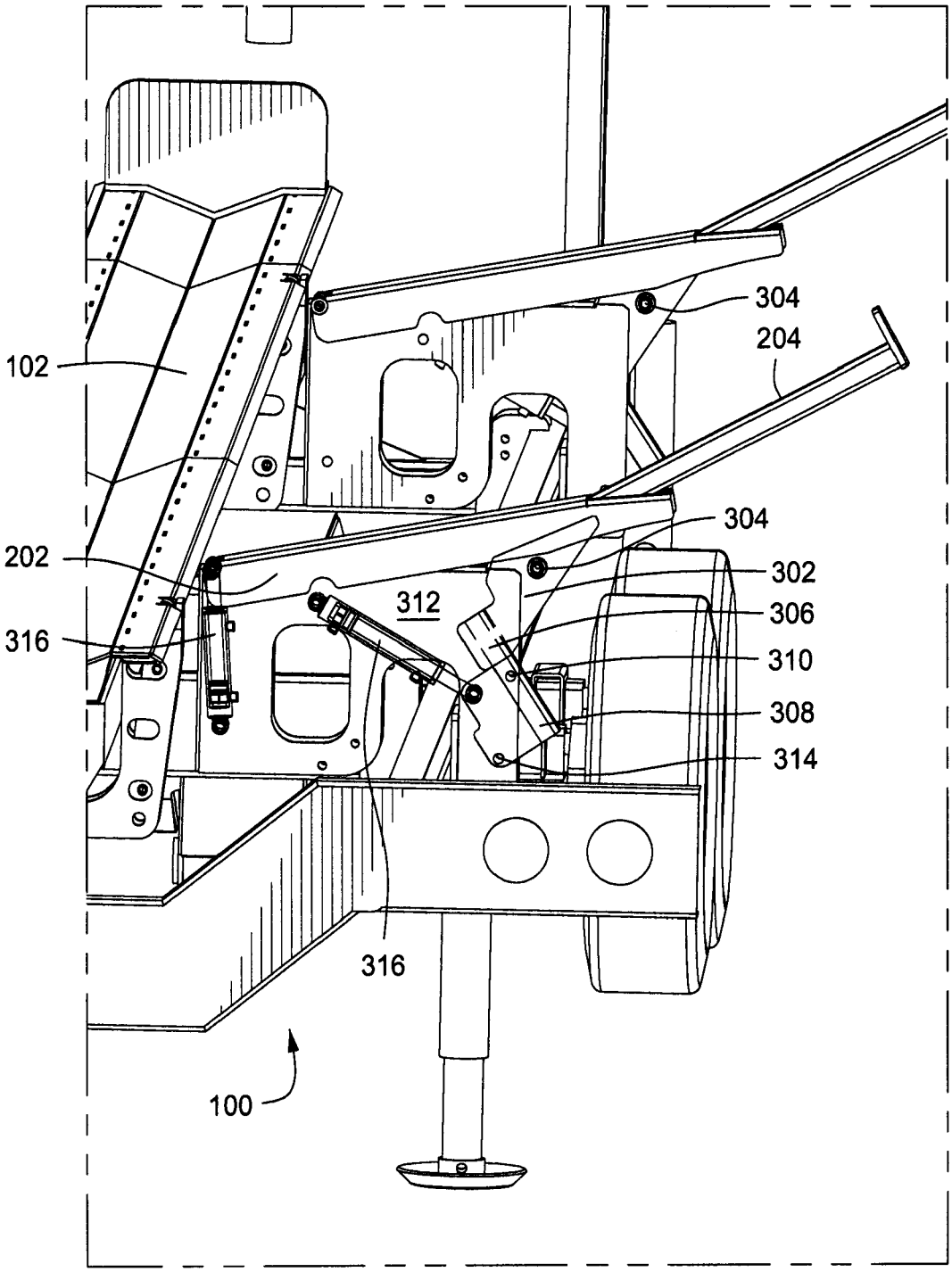
FIG. 3 is a perspective view of a portion of the apparatus shown in FIG. 1.
Figure 4:
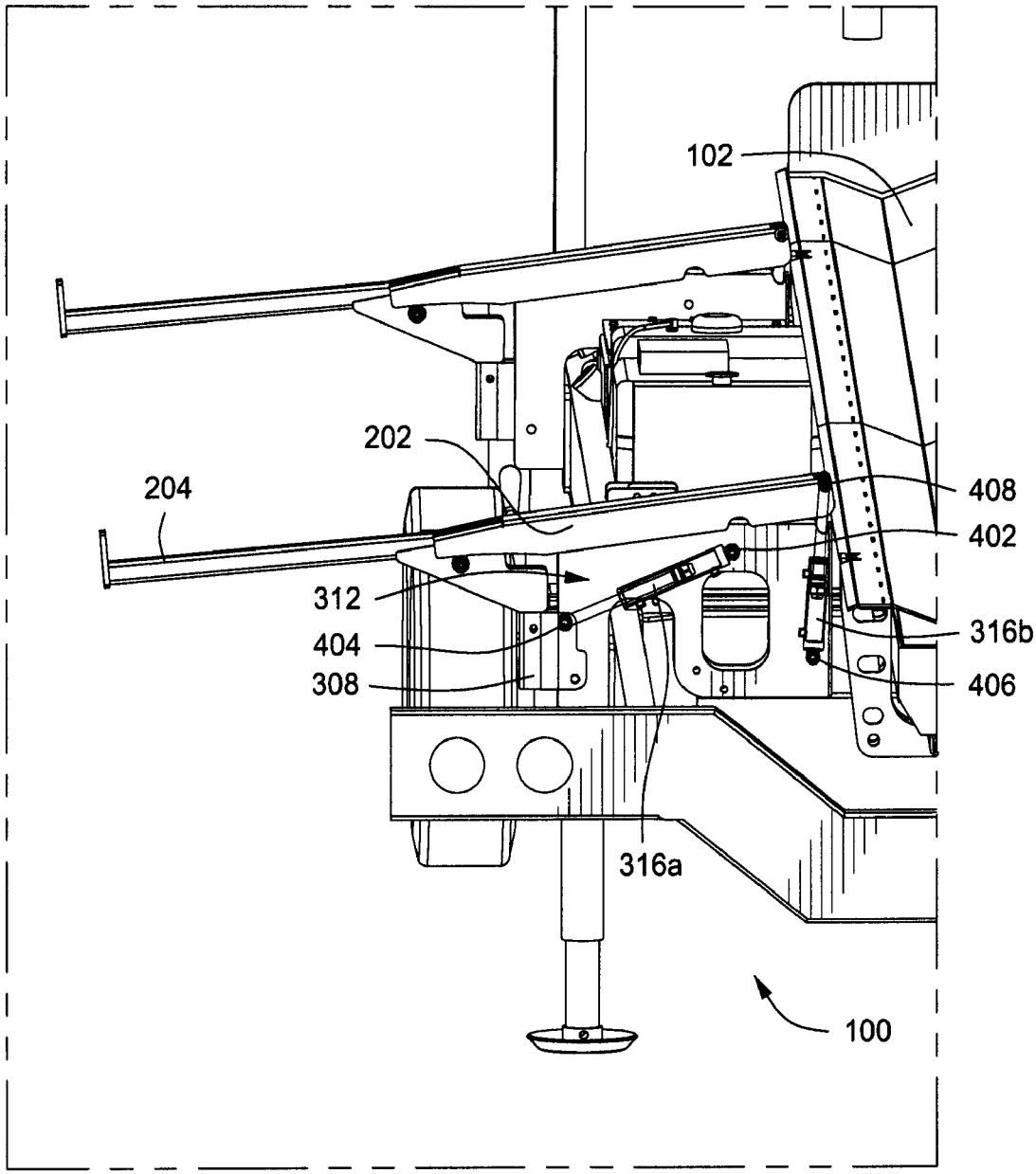
FIG. 4 is a perspective view of a portion of the apparatus shown in FIG. 1.

Referring to FIGS. 3 and 4, illustrated is an exemplary manner in which the indexers 202 and pick up arms 204 operate in unison to urge tubular members towards and/or away from the elongate trough 102. FIG. 3 depicts the pick up arms 204 in an elevated position. In an exemplary embodiment, each pick up arm 204 is attached to a toggle mount 302. A pin 304 is removably coupled to the toggle mount 302 and in exemplary operation may be configured to permit sliding or rolling engagement between the indexers 202 and pick up arms 204 as the pick up arms 204 change elevation. Thus, in exemplary operation, the pick up arms 204 and indexers 202 may work simultaneously to urge tubulars toward a desired direction.

In an exemplary embodiment, the toggle mount 302 may also comprise a tubular shaft 306 extending perpendicularly downward and configured to be inserted into a toggle member 308 that may be configured to accept and seat the particular shape of the tubular shaft 306. As illustrated, the tubular shaft 306 may comprise, but is not limited to, a section of square tubing that is either mechanically coupled or welded to the toggle mount 302. In alternative embodiments, the tubular shaft 306 may also comprise varying tubular shapes, i.e., cylindrical or hexagonal tubulars. Furthermore, a pin 310 may be inserted to prevent axial disengagement between the tubular shaft 306 and the toggle member 308 during operation or transport. For example, by removing the pin 310, the combination lift arm 204 and toggle mount 302 may be detached completely from the apparatus 10, and then rotated and reinserted at an angle substantially parallel to the support structure 100 for transportation purposes.

In an exemplary embodiment, the toggle member 308 may be rotatably mounted to a shroud 312 and configured to rotate about a pivot point 314. The shroud 312 may be attached to the support structure 100 to seat the indexers 202 when not engaged and further house one or more actuators 316. The actuators 316 may be configured to move the indexers 202 and pick up arms 204, thus allowing them to work in unison to urge tubular members towards and away from the elongate trough 102. In exemplary embodiments, the actuators 316 may be hydraulically-operable linear actuators. In alternative embodiments, the actuators 316 may be powered by pneumatics or a geared electric motor.

Referring to FIG. 4, illustrated in an exemplary embodiment is an actuator 316*a* rotatably coupled to the shroud 312 at one end 402 and to a toggle member 308 at the other end 404. By operating the actuator 316*a*, the pick up arm 204 is able to raise (FIG. 3) or lower (FIG. 4). A second actuator 316*b* is rotatably coupled to the shroud 312 at one end 406 and to an indexer 202 at its other end 408. By operating the actuator 316*b*, the indexer 202 may be operable to raise (FIG. 4) or seat itself on the shroud 312 (FIG. 3). In an exemplary embodiment, raised indexers 202 (FIG. 4) may also act as a pipe stop that prevents further rotational motion of a tubular introduced to the elongate trough 102 from the opposite side of the apparatus 10.

Figure 5:
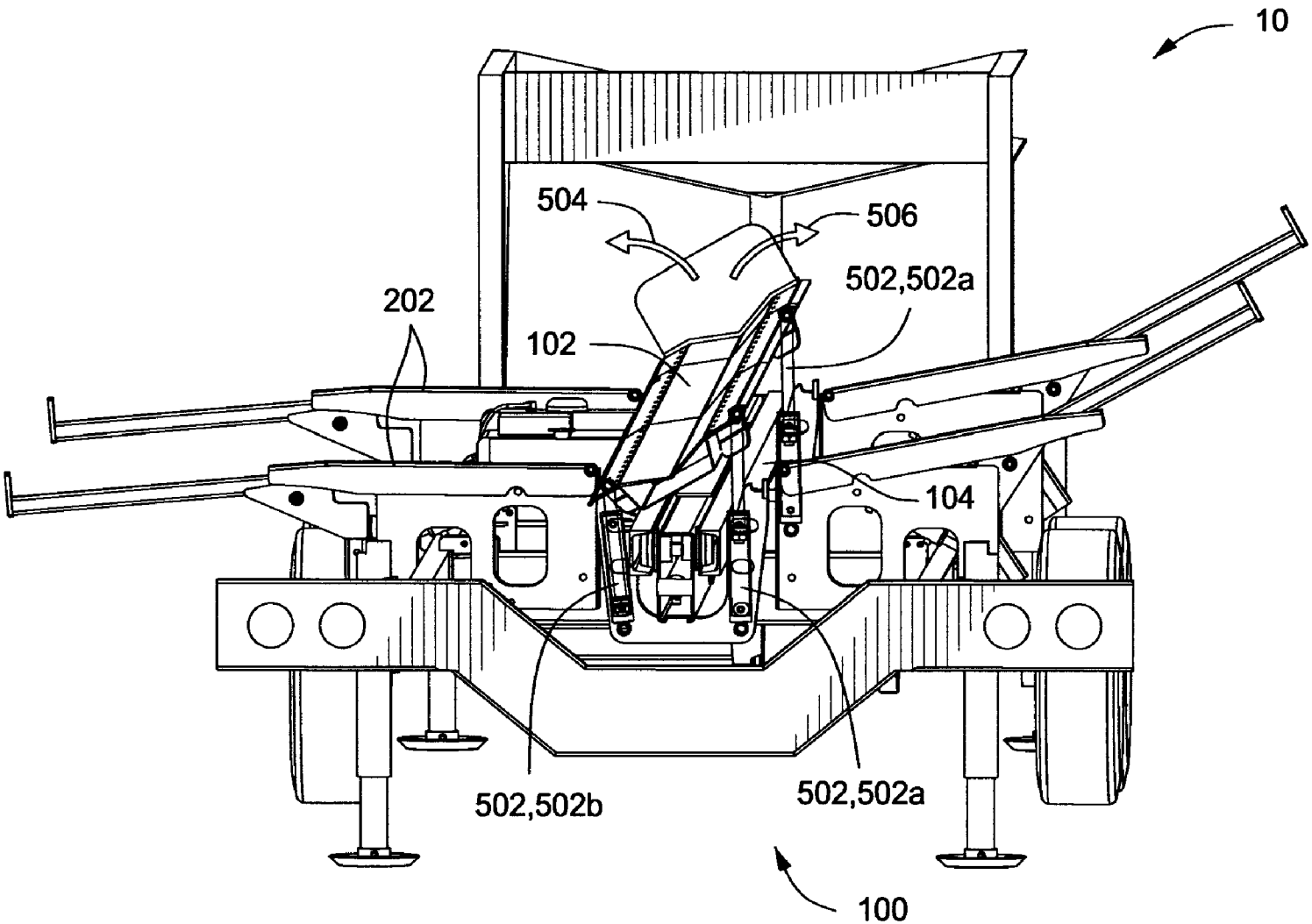
FIG. 5 is a rear perspective view of the apparatus shown in FIG. 1.

Referring to FIG. 5, illustrated is an exemplary embodiment of the apparatus 10 wherein the elongate trough 102 is in a tilted position and thereby configured to discharge a tubular member. When not in operation, the elongate trough 102 lies substantially flush with the adjacent indexers 202. In an exemplary embodiment, one or more of a series of actuators 502 are mounted to the carriage 104 and rotatably coupled at or near the longitudinal edges of the elongate trough 102 at spaced-apart locations. In the illustrated example, triggering the two actuators 502*a* on one side of the elongate trough 102 has the effect of tilting the whole trough 102 in direction 504 relative to the carriage 104, thereby discharging a tubular member onto the adjacent indexers 202. In a reverse example, actuators 502*b* located on the opposite side of the trough 102 may be activated, thus discharging a tubular member in direction 506. This process is further illustrated in FIG. 8, below.

In exemplary embodiments, the actuators 502 may be hydraulically-operable linear actuators and/or may be powered by pneumatics or electric-geared motors. In yet another embodiment (not illustrated), a single actuator 502 may be moveably coupled to the elongate trough 102 and operable to perform the same function as multiple actuators 502.

Figure 6A:
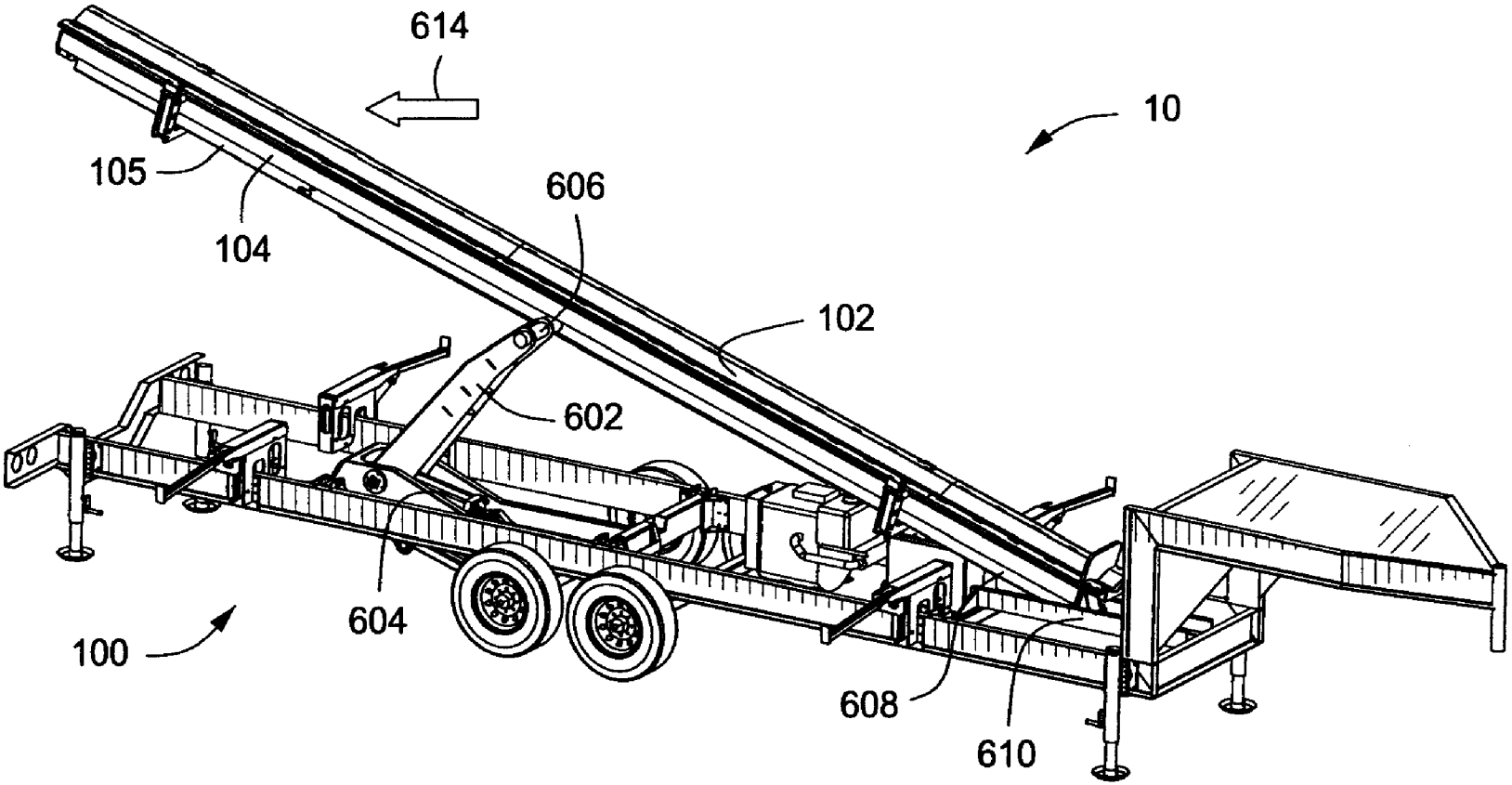
FIG. 6A is a perspective view of the apparatus shown in FIG. 1.
Figure 6B:
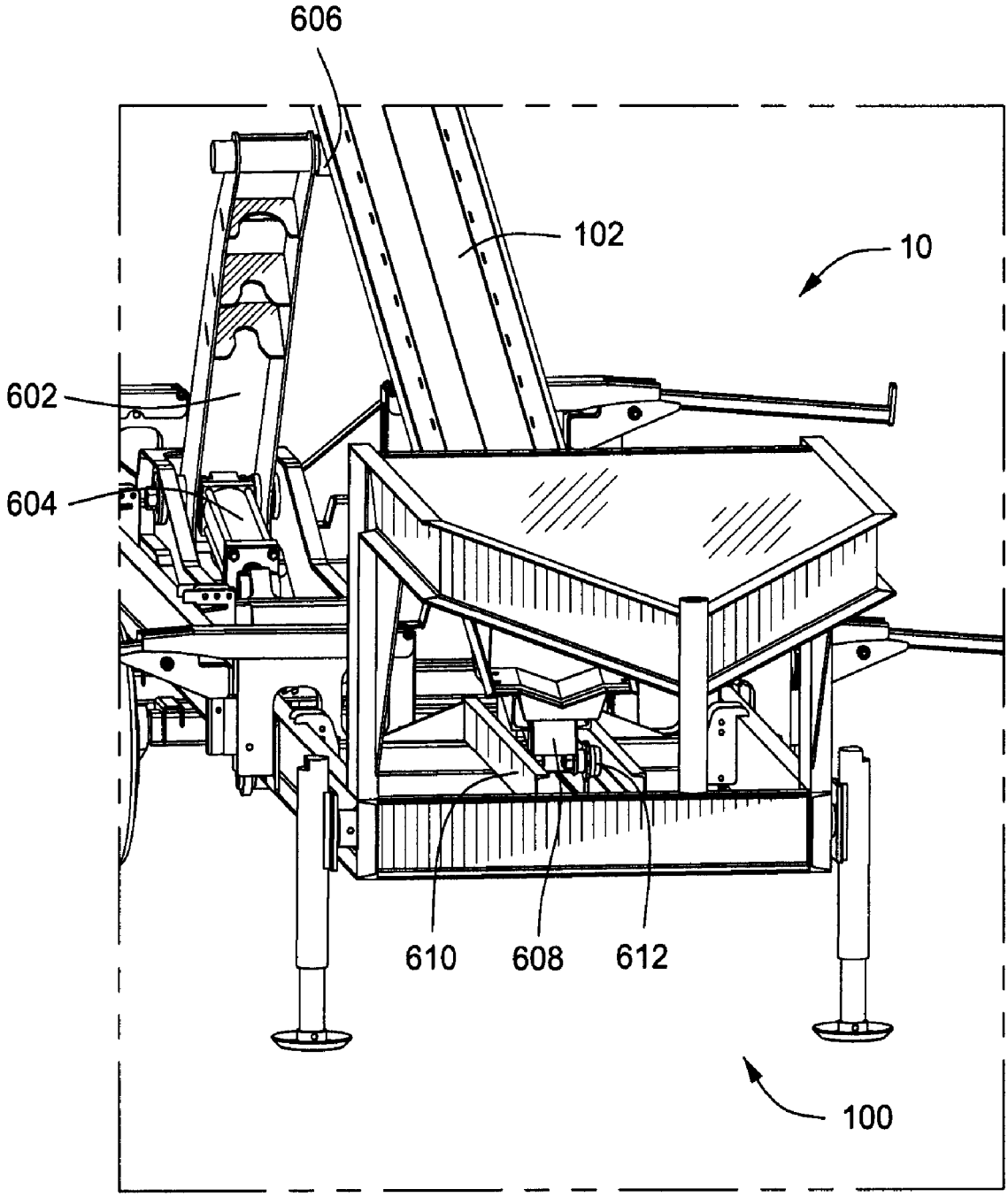
FIG. 6B is a front perspective view of a portion of the apparatus shown in FIG. 6A.

Referring to FIGS. 6A and 6B, illustrated is the apparatus 10 with the carrier 105, carriage 104 and elongate trough 102 combination in an inclined position relative to the support structure 100. In an exemplary embodiment, the apparatus 10 further comprises a lift arm 602 coupled to the support structure 100 and configured to raise the carrier 105, carriage 104 and trough 102 combination to an elevated rig floor position. The lift arm 602 is rotatably coupled to the carrier 105 at pivot point 606 and may further comprise a hydraulic cylinder 604 configured to control the lift arm 602 in its up and down movement.

While the carrier 105 is being raised or lowered, the carrier end 608 is in constant engagement with a support member 610 mounted to the support structure 100. In an exemplary embodiment, the support member 610 may comprise a pair of longitudinally extending brackets that extend perpendicularly from the end of the support structure 100 a short distance. Shown more clearly in FIG. 6B, the carrier end 608 may comprise rollers and/or other rolling means 612 configured to be in rolling engagement with the support member 610. As the lift arm 602 elevates the carrier 105 at pivot point 606, the rolling means 612 secures the carrier end 608 in rolling engagement with the support member 610. In this manner, the combination carrier 105, carriage 104 and elongate trough 102 may be moved in direction 614 (FIG. 6A) to an elevated position adjacent to a rig floor. In an alternative embodiment, the rolling means 612 may comprise any configuration capable of moveable engagement with the support member, i.e., a ball bearing configuration or a sliding engagement.

Figure 6C:
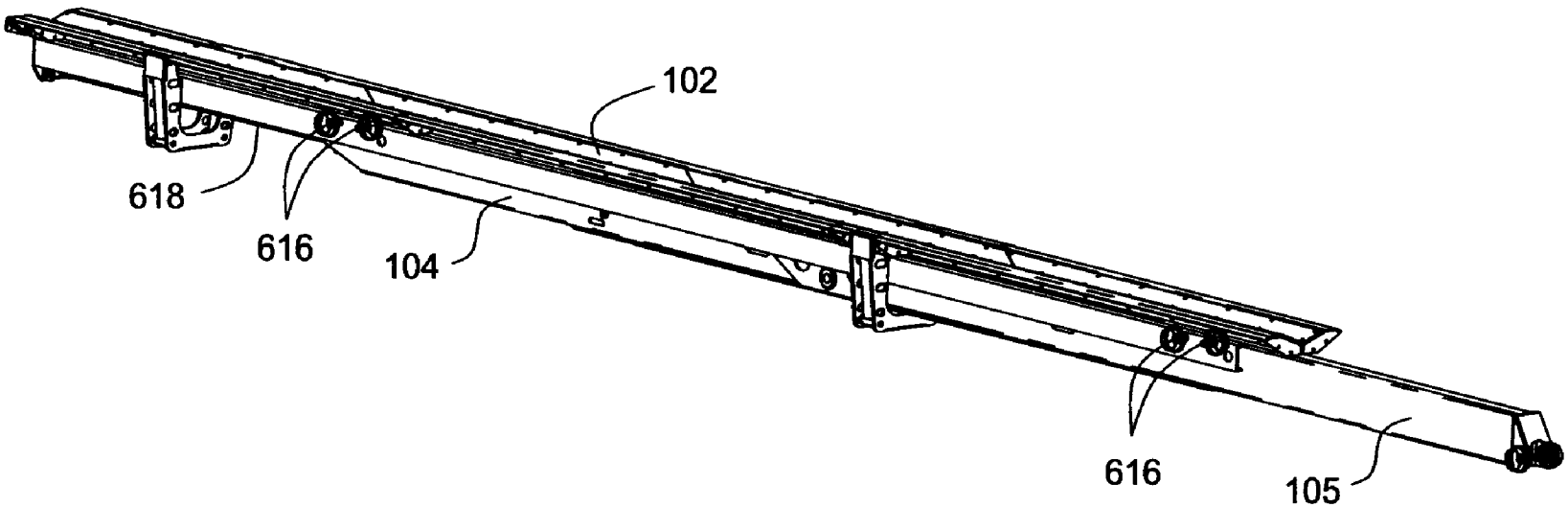
FIG. 6C is a perspective view of a portion of the apparatus as shown in FIG. 6A.

Referring to FIG. 6C, illustrated is an exemplary embodiment of the carrier 105, carriage 104 and elongate trough 102 combination wherein the carriage 104 is extended. In one embodiment, the carrier 105 comprises one or more crown rollers 616 configured to allow longitudinal rolling engagement between the carriage 104 and carrier 105. A hydraulic cylinder 618 (not visible in FIG. 6C) is mounted at one end to the carriage 104 while its other end is mounted to the carrier 105. Upon actuating the hydraulic cylinder 618, the carriage 104 is drawn longitudinally along carrier 105 towards a rig floor. During tubular pick up operations, the operator may use this function to position tubulars over the rig floor or to situate them closer to the hole center. During tubular lay down operations, this function may move the carriage 104 closer to a rig floor worker, thus eliminating the danger in having to lean out over the end of the rig floor in order to place the tubular down on the carriage 104.

Figure 7A:
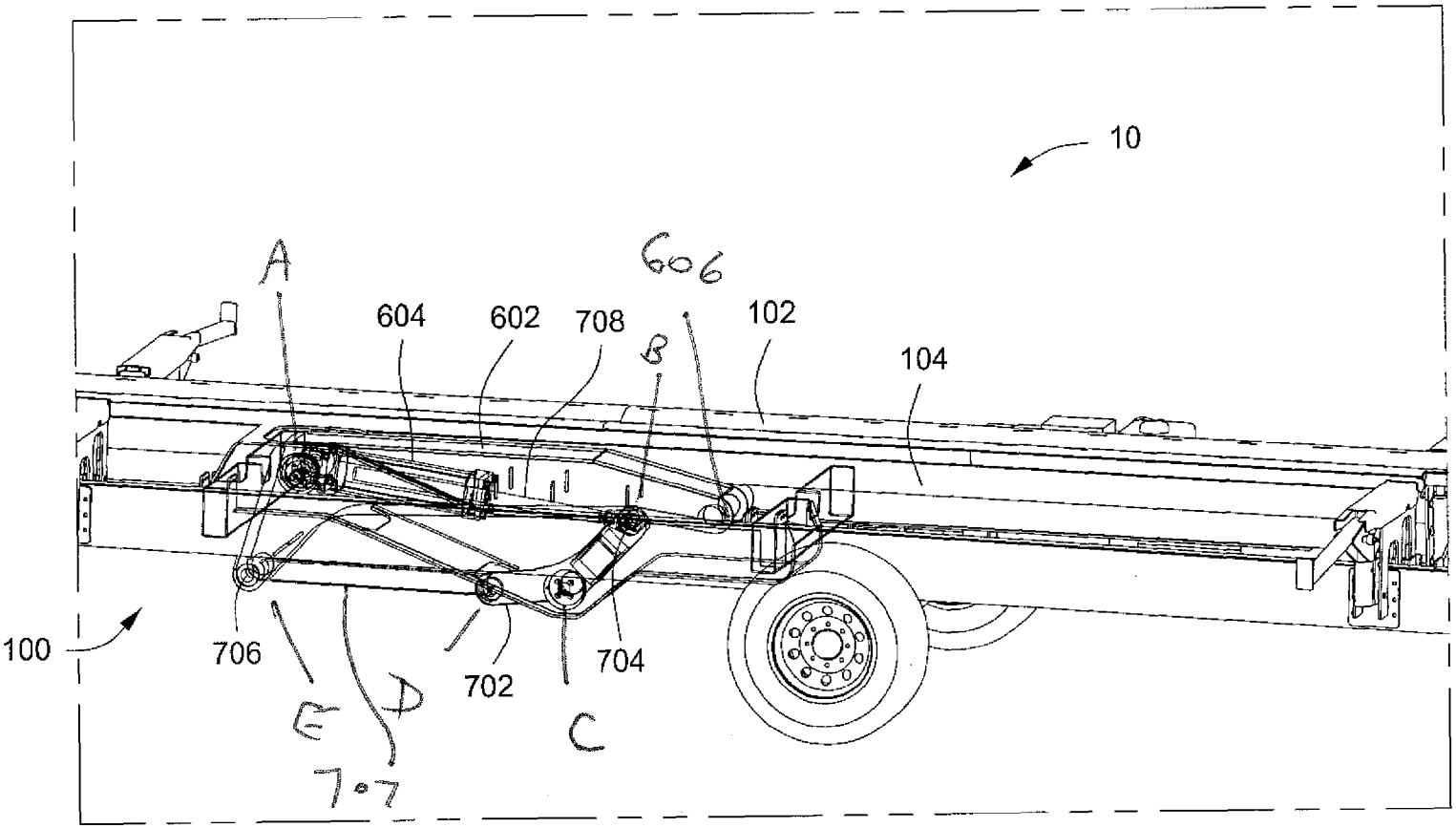
FIGS. 7A-7B are perspective views of a portion of the apparatus shown in FIG. 1.
Figure 7B:
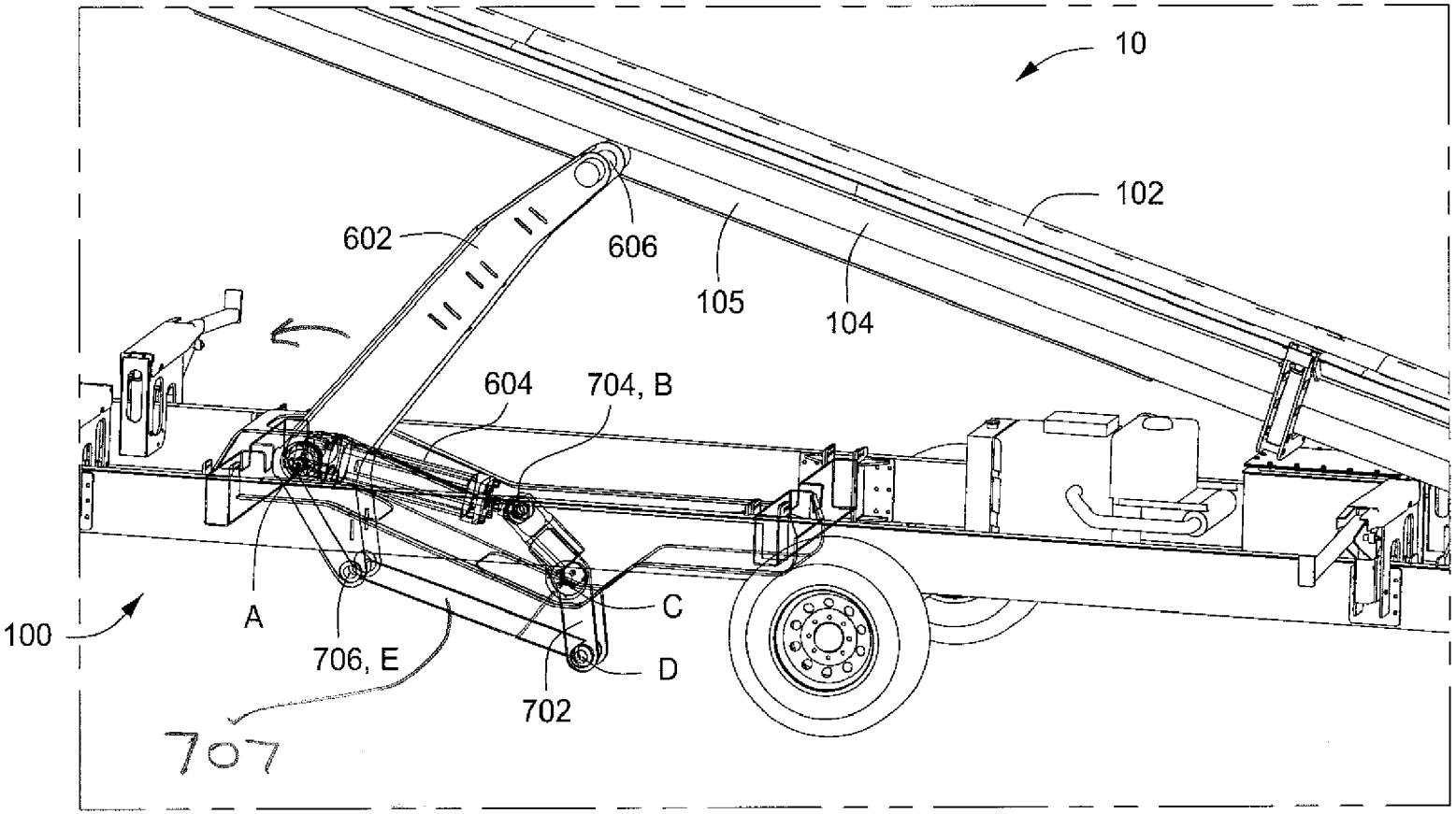

Referring to FIGS. 7A and 7B, illustrated is an example of the function and working components of the lift arm 602. FIG. 7A depicts the carriage 104 in its resting position, and FIG. 7B shows the carriage 104 in an elevated position relative to the support structure 100. In an exemplary embodiment, the lift arm 602 further comprises a linkage 702 pivotally coupled to a rod 708 of the hydraulic cylinder 604 at one point 704 and pivotally coupled to the lift arm 602 at another point 706. In operation, as shown in FIG. 7A, the hydraulic cylinder 604 may be triggered to retract its rod 708, thus rendering a force reaction to the linkage 702 and the lift arm 602. In other words, by retracting the rod 708 into the cylinder 604, the linkage 702 will simultaneously force the lift arm 602 to an elevated height, while translating the elongate trough 102 in a longitudinal direction towards a position proximate a rig floor.

The lifting apparatus, as illustrated in FIG. 7B, operates under the principles of kinetics and kinematics using the mechanical advantage of a slider/crank mechanism combined with the mechanical advantage of a four-bar link mechanism. Specifically, the powered slider/crank mechanism may comprise points A-B-C-D, wherein the hydraulic cylinder 604 (link A-B, which includes rod 708) may constitute the powered slider (A-B) and a rocker bar B-C-D forms the crank mechanism. Rocker bar B-C-D (linkage 702) of FIGS. 7A and 7B pivots around fixed point C on the support structure 100. Rocker bar B-C-D pivots as the elongate trough 102 moves between elevated and lowered positions as shown in FIGS. 7A and 7B. Rod 708 is pivotally coupled to rocker bar B-C-D at end B, point 704 in FIGS. 7A and 7B. End D of boomerang-shaped rocker bar B-C-D is pivotally coupled to an end of the lift arm 602 at point 706, E. FIGS. 7A and 7B show portion C-D of rocker arm B-C-D forms an angle with portion B-C, specifically, when portion B-C is at a vertical orientation and relatively perpendicular to rod 708, portion C-D is angled generally towards the lift arm and at a diagonal angle with the vertical. This shape of rocker arm B-C-D causes portion C-D to become generally aligned (i.e., approaches a parallel position) with the link 707 (which connects points D-E) as rocker arm B-C-D is further rotated in a clock-wise manner when rod 708 extends, as seen in FIG. 7A. In addition, portion C-D has a shorter length than the distance from point E to the pivot point A of lift arm 602 where the hydraulic cylinder 604 attaches to the lift arm 602.

In operation, the lift arm 602 is lowered from its elevated position as shown in FIG. 7B, by the extension of the rod 708 from the hydraulic cylinder 604. As rod 708 extends from its retracted position shown in FIG. 7B, rocker bar B-C-D is rotated clock-wise about fixed point C, and the link 707 thereby pushes on the lift arm 602 through its pivot point 706, causing the lift arm 602 to rotate clock-wise about its pivot point, thus lowering the carriage 104. As rod 708 is further extended and rocker arm B-C-D continues to rotate clock-wise, portion C-D of rocker arm B-C-D becomes aligned with (i.e., moves toward being parallel to) the link 707. As the carriage 104 approaches the support structure 100 when being lowered (as shown comparing FIGS. 7B to 7A), the alignment of portion C-D with link 707 as point D travels in an arc results in the lift arm 602 having a decrease in its angle of rotation compared to the angle of rotation of the rocker arm B-C-D. This result is achieved due to rocker arm B-C-D's relatively perpendicular arrangement with rod 708. Thus, although the rod 708 extends or retracts from the cylinder at a constant speed, and rocker arm B-C-D has a relatively uniform angular rotation, lift arm 602 has a relative decrease in its angle of rotation as link 707 becomes generally aligned with portion C-D of the rocker arm B-C-D. Thus, maximum mechanical advantage is reached while retracting (i.e., raising the lift arm 602) or extending (i.e., lowering the lift arm 602) the cylinder 604 (link A-B) at a constant speed, because of the non-linear decrease in the angle of rotation of coupler-link B-C. This allows for greater control over the movement of the carrier 105 in FIG. 7B as it may be brought to rest on the support structure 100 in a controlled and non-abusive fashion. The lifting apparatus is thereby configured to reduce or eliminate the need for flow controls.

Figure 8:
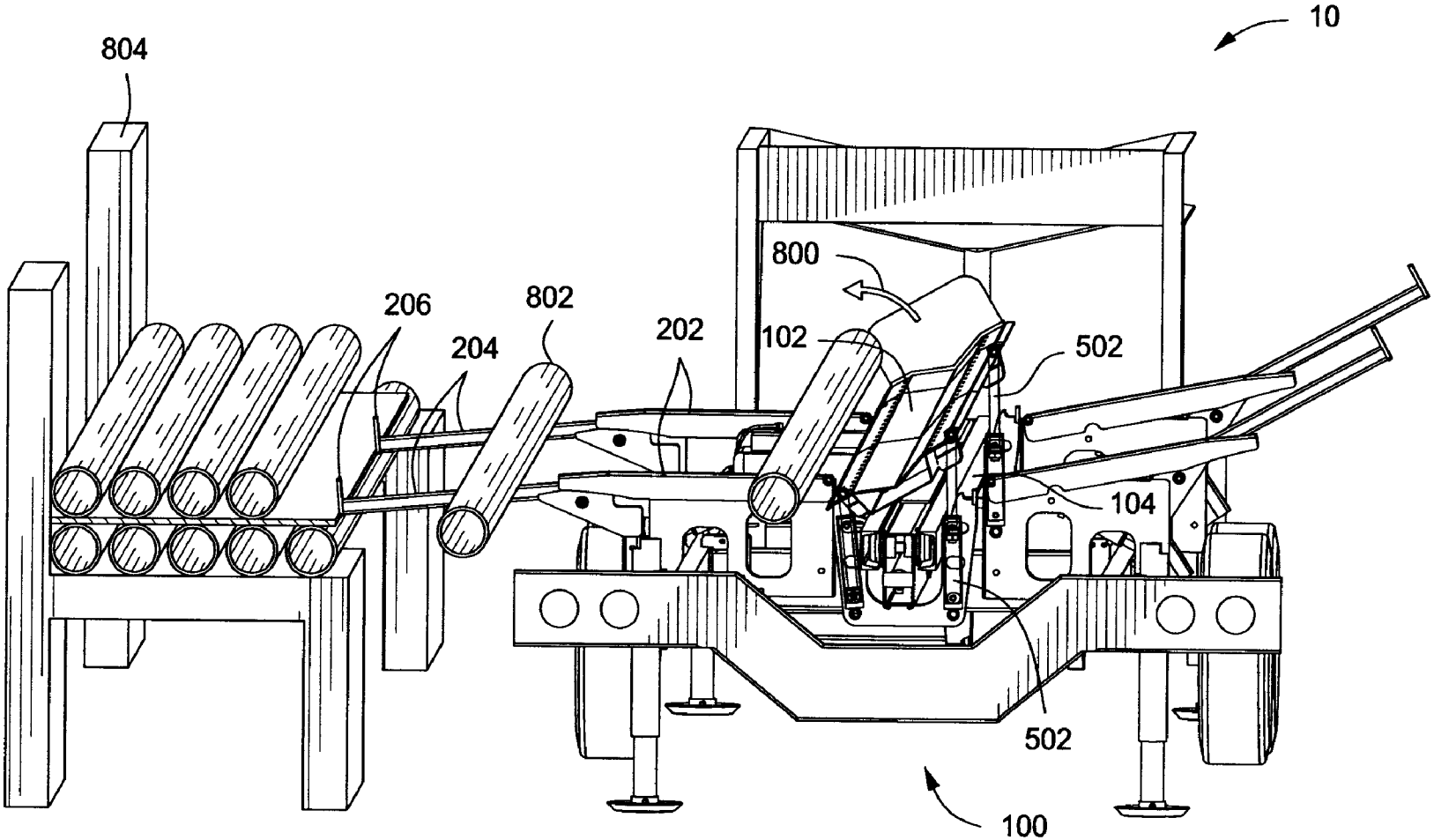
FIG. 8 is a rear perspective view of the apparatus shown in FIG. 1.

Referring to FIG. 8, illustrated is an exemplary embodiment of operation of the apparatus 10. As illustrated, a tubular 802 may be discharged from the elongate trough 102 in direction 800 by tilting the trough 102 using the actuators 502. The tubular then may roll over the indexers 202 and urged onto the pick up arms 204, finally being stopped at the pipe stop ends 206. From the pipe stop ends 206, the tubular 802 may then be aligned with and placed on an adjacent pipe storage rack 804 for storage. This process may also be reversed in an alternative embodiment of operation, as disclosed herein. For example, user may pick up a tubular 802 from an adjacent storage rack 804 by activating the pick up arms 204, as described in FIGS. 3-4. Once a tubular 802 is picked up, the pick up arms 204 may be raised to urge the tubular 802 onto the indexers 202 and into the elongate trough 102.

One skilled in the art will recognize that the apparatus 10 may be powered by any number of means of alternative power sources. For example, the apparatus 10 may be powered by a diesel engine, or any engine of substantially equivalent power output. In an exemplary embodiment, the apparatus 10 is manually operated using manual hydraulic controls. The apparatus 10 may also or alternatively be controlled via an optional wireless remote.

An apparatus capable of moving a tubular member to and from an elevated drilling rig floor has been described. The apparatus may comprise a support structure configured to be positioned adjacent a pipe rack. It may also comprise a carrier moveably coupled to the support structure, and a carriage moveably coupled to the carrier. A trough may extend longitudinally over the support structure and be moveably coupled to the carriage, wherein the trough is configured to receive a tubular member. The trough may be operable to tilt relative to the support structure thereby discharging a tubular.

The apparatus may further comprise a lift arm that is be coupled between the support structure and the carrier and operable to move the carrier and carriage relative to the support structure, thereby also moving the tubular member received in the trough The apparatus may also comprise a plurality of indexers each coupled to the support structure and operable to urge the tubular member toward the trough, and a plurality of pick up arms each slidingly engaged with a corresponding one of the plurality of indexers and operable to retrieve the tubular member from the pipe rack by tilting relative to the support structure. The support structure may further comprise a plurality of leveling legs that are collectively operable to raise, lower and tilt the support structure relative to the underlying terrain.

An apparatus has also been described that comprises a support structure having a carriage and a trough movably coupled to a carrier, wherein a lift arm may be coupled between the support structure and the carrier. The lift arm may be laterally offset from being vertically aligned with the carrier. The apparatus further comprises an actuator having a first end coupled to the support structure and a linkage coupled between the lift arm and a second end of the actuator, wherein the linkage is operable to transfer operational force of the actuator to the lift arm to raise and lower the carrier, carriage and trough relative to the support structure. Therefore, the lift arm, the actuator, and the linkage may be configured to cooperatively raise the trough from a retracted trough position in which the trough is substantially horizontal and parallel to the support structure.

A method for moving a tubular member relative to a drilling rig floor has also been disclosed, the method comprising picking up a tubular member from a pipe rack adjacent to a support structure by operating a plurality of actuators, each coupled to a corresponding one of a plurality of pick up arms. The method further comprises operating the actuators to urge the tubular member onto a plurality of indexers and into a trough extending longitudinally above the support structure, and then operating a lift arm to move the trough and the tubular member therein to an elevated position over the support structure.

A method for moving a tubular member from a drilling rig floor relative to the ground has also been disclosed, the method comprising placing the tubular member lengthwise in a trough that extends angularly from a support structure towards the rig floor and operating a lift arm to lower the trough and the tubular member therein towards the support structure. The method further comprises operating a plurality of actuators to tilt the trough to one side thereby discharging the tubular member towards a plurality of indexers. Operating the plurality of indexers to move the tubular member towards a corresponding plurality of pick up arms, and operating the plurality of pick up arms that to lower the tubular member onto a pipe rack that is proximate the support structure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. For example, the present disclosure may also be used in the logging industry where the tubular members may be replaced by timbers. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus for moving a tubular member, comprising:

a support structure configured to be positioned adjacent a pipe rack;

a carrier that is moveably coupled between an elevated position and a lowered position to the support structure and that has a varying amount of angular rotation when raised and lowered;

a carriage moveably coupled to the carrier;

a trough extending longitudinally over the support structure and moveably coupled to the carriage, the trough configured to receive a tubular member;

a lift arm coupled between the support structure and the carrier and operable to move the carrier and carriage relative to the support structure, thereby also moving the tubular member received in the trough;

an actuator having a first end coupled to the support structure and a retractable cylinder at a second end;

a linkage including a rocker bar coupled between the lift arm and the retractable cylinder of the actuator, wherein the linkage is operable to transfer operational force of the actuator to the lift arm to raise and lower the carrier, carriage and trough relative to the support structure;

wherein the rocker bar and the lift arm are coupled so that, as the cylinder is extended or retracted at a constant speed, the lift arm has a non-linear decrease in the angle of rotation when the carrier is adjacent to the lowered position relative to a non-linear increase in the angle of rotation when the carrier is adjacent to the elevated position;

a plurality of indexers each coupled to the support structure and operable to urge the tubular member toward the trough; and a plurality of pick up arms each slidingly engaged with a corresponding one of the plurality of indexers and operable to retrieve the tubular member from the pipe rack by tilting relative to the support structure.

2. The apparatus of claim 1 further comprising a plurality of actuators each coupled to a corresponding one of the plurality of indexers and operable to independently raise and lower each of the plurality of indexers relative to the support structure.

3. The apparatus of claim 1 further comprising a plurality of leveling legs each coupled to the support structure and collectively operable to raise, lower, and tilt the support structure relative to underlying terrain.

4. The apparatus of claim 1 wherein the trough is operable to tilt relative to the support structure.

5. The apparatus of claim 4 further comprising a plurality of hydraulically-operable linear actuators collectively operable to tilt the trough relative to the support structure.

6. The apparatus of claim 1 further comprising a support member attached to a first end of the support structure and longitudinally extending a distance towards a second end of the support structure, wherein the carrier is moveably coupled to the support member.

7. The apparatus of claim 6 wherein the support member is configured for rolling engagement with the carrier.

8. The apparatus of claim 1 wherein the plurality of indexers each have a proximal end and a distal end relative to the trough, and wherein the plurality of pipe arms are each rotatably arranged at the corresponding distal ends of each of the plurality of indexers.

9. An apparatus for moving a tubular member, comprising:

a support structure configured to be positioned adjacent a pipe rack;

a carrier moveably coupled to the support structure;

a carriage moveably coupled to the carrier;

a trough extending longitudinally over the support structure and moveably coupled to the carriage, the trough configured to receive a tubular member;

a lift arm coupled between the support structure and the carrier and operable to move the carrier and carriage relative to the support structure, thereby also moving the tubular member received in the trough;

a plurality of indexers each coupled to the support structure and operable to urge the tubular member toward the trough;

a plurality of pick up arms each slidingly engaged with a corresponding one of the plurality of indexers and operable to retrieve the tubular member from the pipe rack by tilting relative to the support structure; and a plurality of engagement pins each positionally fixed on a corresponding one of the plurality of pick up arms and slidingly engaged with a corresponding one of the plurality of indexers.

10. An apparatus for moving a tubular member, comprising:

a support structure configured to be positioned adjacent a pipe rack;

a carrier moveably coupled to the support structure;

a carriage moveably coupled to the carrier;

a trough extending longitudinally over the support structure and moveably coupled to the carriage, the trough configured to receive a tubular member;

a lift arm coupled between the support structure and the carrier and operable to move the carrier and carriage relative to the support structure, thereby also moving the tubular member received in the trough;

a plurality of indexers each coupled to the support structure and operable to urge the tubular member toward the trough;

a plurality of pick up arms each slidingly engaged with a corresponding one of the plurality of indexers and operable to retrieve the tubular member from the pipe rack by tilting relative to the support structure; and a plurality of actuators each coupled to a corresponding one of the plurality of pick up arms and operable to simultaneously raise and lower the corresponding one of the plurality of pick up arms and a corresponding one of the plurality of indexers relative to the support structure.

11. An apparatus, comprising:

a support structure having a carrier, carriage and a trough movably coupled to the carriage;

a lift arm coupled between the support structure and the carrier;

an actuator having a first end coupled to the support structure and a retractable cylinder at a second end; and a linkage including a rocker bar coupled between the lift arm and the retractable cylinder of the actuator, wherein the linkage is operable to transfer operational force of the actuator to the lift arm to raise and lower the carrier, carriage and trough relative to the support structure, wherein the linkage and actuator are arranged so that as the cylinder is extended at a constant speed the carrier is lowered onto the support structure through a non-linear decrease in the angle of rotation of the lift arm so as to slow the motion of the carrier relative to when the carrier is adjacent an elevated position away from the support structure.

12. The apparatus of claim 11 wherein the lift arm is laterally offset from being vertically aligned with the carrier.

13. The apparatus of claim 11 wherein the lift arm, the actuator, and the linkage are configured to cooperatively raise the trough from a retracted trough position in which the trough is substantially horizontal and parallel to the support structure.

14. A method for moving a tubular member to an elevated position, comprising:

picking up the tubular member from a pipe rack adjacent to a support structure by operating a plurality of actuators each coupled to a corresponding one of a plurality of pick up arms;

operating the actuators to urge the tubular member onto a plurality of indexers and into a trough extending longitudinally above the support structure; and operating an actuator to retract a cylinder to raise a lift arm to move the trough and the tubular member therein to an elevated position over the support structure, wherein the lift arm is coupled to a linkage including a rocker bar that is arranged so that as the cylinder is retracted at a constant speed and the rotatable link approaches a perpendicular alignment with the cylinder the rotatable link has a non-linear decrease in its angle of rotation.

15. The method of claim 14 wherein each of the plurality of actuators comprises a hydraulically-operable linear actuator.

16. The method claim of 14 wherein each of the plurality of indexers comprises a hydraulically-operable linear actuator.

17. The method claim of 14 wherein operating the lift arm comprises operating a hydraulic cylinder coupled between the lift arm and the trough.

18. A method for moving a tubular member from a rig floor to a pipe rack, comprising:

placing the tubular member lengthwise in a trough that extends angularly from a support structure towards the rig floor and that has a varying speed of rotation in operation;

operating an actuator to extend a cylinder to lower a lift arm to lower the trough and the tubular member therein towards the support structure, wherein the lift arm is coupled to a linkage including a rocker bar connected to the cylinder and that is arranged so that as the cylinder is extended at a constant speed and as the rocker bar approaches perpendicular alignment with the cylinder the rocker bar has a non-linear decrease in the angle of rotation;

operating a plurality of actuators to tilt the trough to one side and discharge the tubular member towards a plurality of indexers;

operating the plurality of indexers to move the tubular member towards a corresponding plurality of pick up arms; and operating the plurality of pick up anus to lower the tubular member onto a pipe rack that is proximate the support structure.

19. The method of claim 18 wherein each of the plurality of actuators comprises a hydraulically-operable linear actuator.

20. The method of claim 18 wherein each of the plurality of indexers comprises a hydraulically-operable linear actuator.

21. The method of claim 18 wherein each of the plurality of pick up arms comprises a hydraulically-operable linear actuator.

* * * * *

UNITED STATES PATENT AND TRADEMARK OFFICE

CERTIFICATE OF CORRECTION

PATENT NO. : 8,016,536 B2
APPLICATION NO. : 12/098151
DATED : September 13, 2011
INVENTOR(S) : Gerber et al.

It is certified that error appears in the above-identified patent and that said Letters Patent is hereby corrected as shown below:

Claim 18 at Column 10, line 29: Please change --anus-- to "arms."

Signed and Sealed this
Twenty-ninth Day of November, 2011

David J. Kappos

David J. Kappos
*Director of the United States Patent and Trademark Office*